US006948429B2

(12) United States Patent
Kawaguchi et al.

(10) Patent No.: US 6,948,429 B2
(45) Date of Patent: Sep. 27, 2005

(54) FLEXOGRAPHIC PRINTING PLATE MOUNTING SHEET

(75) Inventors: Hiromasa Kawaguchi, Komagane (JP); Hideo Ikoma, Komagane (JP); Takako Yuzawa, Komagane (JP)

(73) Assignee: NHK Spring Co., Ltd., Kanagawa (JP)

( * ) Notice: Subject to any disclaimer, the term of this patent is extended or adjusted under 35 U.S.C. 154(b) by 0 days.

(21) Appl. No.: 10/793,473

(22) Filed: Mar. 4, 2004

(65) Prior Publication Data

US 2004/0194652 A1 Oct. 7, 2004

(30) Foreign Application Priority Data

Mar. 5, 2003 (JP) ..... 2003-058613

(51) Int. Cl.[7] ..... B41N 1/00
(52) U.S. Cl. ..... 101/395; 101/375
(58) Field of Search ..... 101/401.1, 375, 101/395, 376, 379, 368, 369, 493, 216, 217

(56) References Cited

FOREIGN PATENT DOCUMENTS

| | | |
|---|---|---|
| GB | BP 1 533 431 | 11/1978 |
| JP | 10-501192 | 2/1998 |
| WO | WO 95/32851 | 12/1995 |

*Primary Examiner*—Anthony H Nguyen
(74) *Attorney, Agent, or Firm*—McGlew and Tuttle, P.C.

(57) ABSTRACT

A flexographic printing plate mounting sheet is provided which improves the printing accuracy by its high level of thickness accuracy and ease of installation in the correct position, which makes it possible to peel a flexographic printing plate off without damaging a foamed substrate, and which maintains appropriate cushioning properties. The foamed substrate of the flexographic printing plate mounting sheet has an adhesive layer on one side and a polyethylene terephthalate film on the other side. The polyethylene terephthalate film has on its remaining side an adhesive layer that is protected by release paper. The foamed substrate and the polyethylene terephthalate film are unitarily formed. The foamed substrate is made of urethane foam having a density of 0.3 to 0.6 g/cm$^3$. The polyethylene terephthalate film is 12 to 50 $\mu$m in thickness.

4 Claims, 3 Drawing Sheets

FLEXOGRAPHIC PRINTING PLATE MOUNTING SHEET

BACKGROUND OF THE INVENTION

1. Field of the Invention

The present invention relates to a flexographic printing plate mounting sheet that doubles as a cushioning element used between a flexographic printing plate and an impression cylinder in flexographic printing.

2. Description of the Related Art

In flexographic printing, a flexographic printing plate is mounted to a plate cylinder of an impression cylinder to produce a printed copy. Of various conventional methods that have been proposed to mount a flexographic printing plate to an impression cylinder, double-sided adhesive sheets for mounting a press plate have been popular lately because of their ease of use and ability to achieve accurate printing. Such double-sided adhesive sheets for mounting a press plate are obtained by forming an adhesive layer on each side of a substrate made from an elastic, foamed body that has resilience against compression, and double as a cushioning element between the flexographic printing plate and the impression cylinder.

FIG. 2 is a partial sectional view showing an example of prior art. In FIG. 2, a flexographic printing plate 19 is mounted to an impression cylinder 18 with the use of a double-sided adhesive sheet 11 for mounting a press plate. The double-sided adhesive sheet 11 for mounting a press plate is composed of a foamed substrate 12, which has adhesive layers 13 and 14 formed on its respective sides. The flexographic printing plate 19 is stuck to the adhesive layer 13 on one side and the impression cylinder 18 is stuck to the adhesive layer 14 on the other side. In this way, the flexographic printing plate 19 can readily be attached and mounted to the impression cylinder 18.

However, there are some inconveniences to the conventional double-sided adhesive sheet 11 for mounting a press plate in which the foamed substrate 12 has the adhesive layers 13 and 14 formed on its respective sides. When stripping the double-sided adhesive sheet 11 from the impression cylinder 18, the substrate 12 and the adhesive layer 14 could be delaminated leaving, on the impression cylinder 18, the adhesive and/or small pieces torn off of the foamed substrate 12 and adding a labor of cleaning the residues. Furthermore, the double-sided adhesive sheet 11 cannot be used repeatedly with the foamed substrate 12 torn upon peeling off of the adhesive sheet and with the adhesive layer 14 made uneven in thickness by the adhesive left on the impression cylinder 18.

In an attempt to counter these problems, a flexographic printing plate mounting sheet (see JP 10-501192 A, for example) and a double-sided adhesive sheet for mounting a press plate with an intervening plastic film serving as a reinforcing sheet (see BP 1533431 B), for example) have been proposed.

FIG. 3 is a frontal explanatory diagram showing a partially enlarged view of a double-sided adhesive sheet for mounting a press plate with an intervening plastic film serving as a reinforcing sheet. In FIG. 3, a double-sided adhesive sheet 11 for mounting a press plate is composed of a foamed substrate 12, which has an adhesive layer 14 on one side and an adhesive layer 17 and a plastic film 15 on the other side. The remaining side of the plastic film 15 has an adhesive layer 13, which is protected by a release liner (release paper) 16. With the side on which the plastic film 15 is formed fixed to an impression cylinder 18, the double-sided adhesive sheet 11 for mounting a press plate can be peeled off without tearing the foamed substrate 12 or leaving an adhesive residue owing to the presence of the plastic film 15.

In flexographic printing of which higher printing accuracy is demanded, a flexographic printing plate has to meet strict standards for thickness accuracy and positioning accuracy. Accordingly, a flexographic printing plate mounting sheet too is required to have uniform thickness accuracy as well as appropriate cushioning properties and, upon installation, the ease of positioning relative to an impression cylinder without fail.

In light of this, none of conventional flexographic printing plate mounting sheets, which use as a foamed substrate a slice of polyethylene or other thermoplastic foam with a width of 30 to 1500 mm and a thickness of 0.3 to 0.5 mm or a thin urethane sheet coated with an adhesive on each side, have uniform thickness accuracy. The thickness fluctuation lowers the printing accuracy and gives the printed copy poor quality.

Furthermore, conventional flexographic printing plate mounting sheets are usually opaque and obscure positioning marks on an impression cylinder, which makes correct positioning on the marked impression cylinder difficult. With a flexographic printing plate mounting sheet positioned incorrectly on an impression cylinder, a flexographic printing plate is mounted misaligned to the impression cylinder and the printing accuracy is lowered.

Moreover, conventional flexographic printing plate mounting sheets lose appropriate cushioning properties through repeated use since their foamed substrates do not have proper distortion characteristics, thereby cutting short their life spans.

SUMMARY OF THE INVENTION

The present invention has been made to solve those problems in prior art, and an object of the present invention is therefore to provide a flexographic printing plate mounting sheet that is capable of improving the printing accuracy, that manages peeling of a flexographic printing plate without damaging a foamed substrate, and that maintains appropriate cushioning properties.

In order to solve the above-mentioned problem, according to the present invention, there is provided a flexographic printing plate mounting sheet including a foamed substrate. The foamed substrate has an adhesive layer on one side and a polyethylene terephthalate film on the other side. The polyethylene terephthalate film has on its remaining side an adhesive layer that is protected by release paper. In the flexographic printing plate mounting sheet, the foamed substrate and the polyethylene terephthalate film are unitarily formed; the foamed substrate is made of urethane foam having a density of 0.3 to 0.6 g/cm$^3$; and the polyethylene terephthalate film has a thickness of 12 to 50 $\mu$m.

Since the foamed substrate and the polyethylene terephthalate film are unitarily formed, the thickness accuracy is improved and higher printing accuracy is obtained. In addition, with the polyethylene terephthalate film interposed between the foamed substrate and the adhesive layer to which a flexographic printing plate is adhered, peeling of the flexographic printing plate does not break the foamed substrate to leave pieces of the torn foamed substrate and/or the adhesive on the flexographic printing plate. Furthermore, the polyethylene terephthalate film serves as a reinforcing member to prevent overstretch of the foamed substrate.

The thickness of the polyethylene terephthalate film is set to 12 to 50 μm because, when thinner than 12 μm, the polyethylene terephthalate film cannot have sufficient reinforcing power over the foamed substrate to protect the foamed substrate against breakage whereas a polyethylene terephthalate film thicker than 50 μm could impair the elasticity and resilience (cushioning properties) of the foamed substrate.

Urethane foam having a density of 0.3 to 0.6 g/cm$^3$ is chosen for the foamed substrate in order to improve the distortion characteristics of the flexographic printing plate mounting sheet, which enables the flexographic printing plate mounting sheet to maintain appropriate cushioning properties for a long period of time and to stand up to much repeated use.

The polyethylene terephthalate film of the present invention is a type of polyester film.

The flexographic printing plate mounting sheet of the present invention is characterized in that the closed cell content of the urethane foamed substrate is equal to or higher than 30% and equal to or lower than 60%.

This way the distortion characteristics of the flexographic printing plate mounting sheet are improved and the flexographic printing plate mounting sheet can maintain appropriate cushioning properties for a long period of time. The reason why the closed cell content is set to 30% or more and 60% or less is that a closed cell content outside of this range cannot provide the flexographic printing plate mounting sheet with appropriate cushioning properties.

The flexographic printing plate mounting sheet of the present invention has a total light transmittance of 55% or higher with the release paper removed.

Accordingly, the flexographic printing plate mounting sheet is made transparent or translucent, thereby allowing positioning marks on an impression cylinder or the like to be seen through the flexographic printing plate mounting sheet when mounting a flexographic printing plate to the impression cylinder. Precise positioning and installation in the correct position can therefore be readily achieved without causing misalignment.

DETAILED DESCRIPTION OF THE PREFERRED EMBODIMENTS

Figure 1:
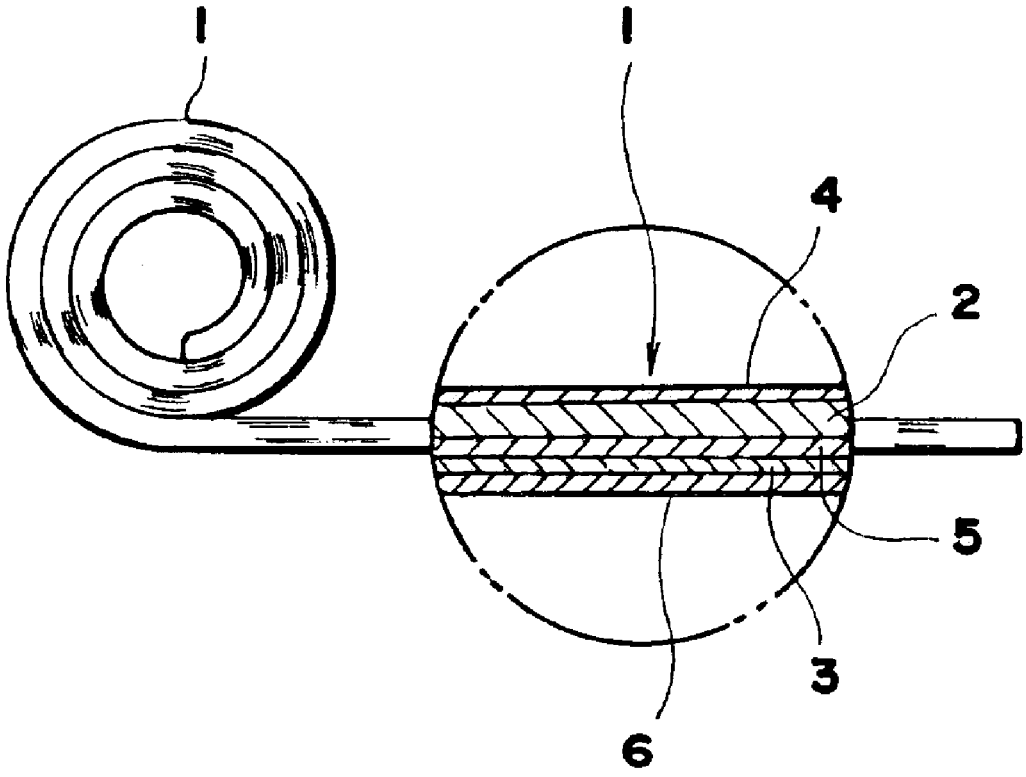
FIG. 1 is a frontal view showing a partially enlarged view of an embodiment of the present invention.
Figure 2:
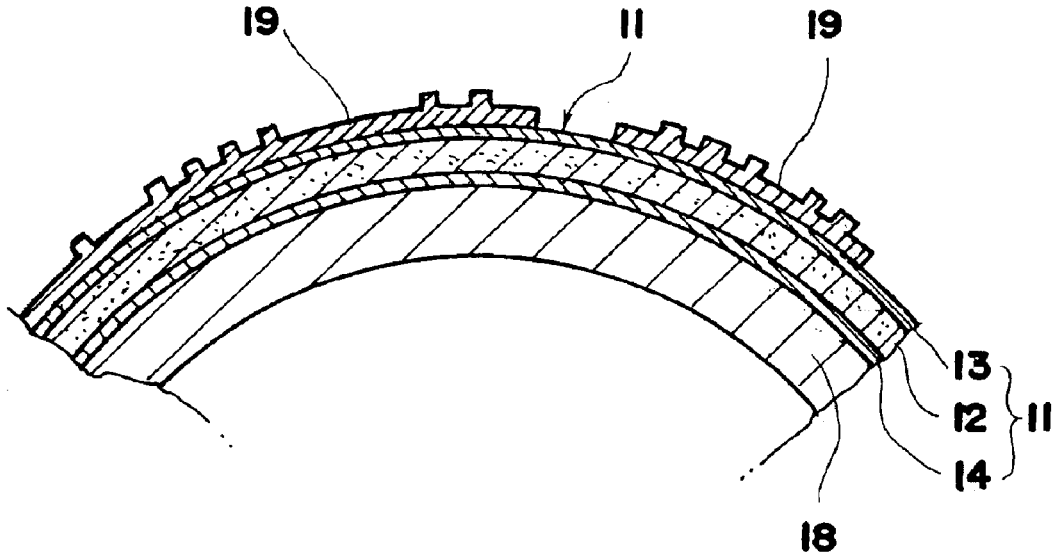
Fig.2 (Prior Art)
FIG. 2 is a partial sectional view showing a conventional double-sided adhesive sheet for mounting a press plate in use.
Figure 3:
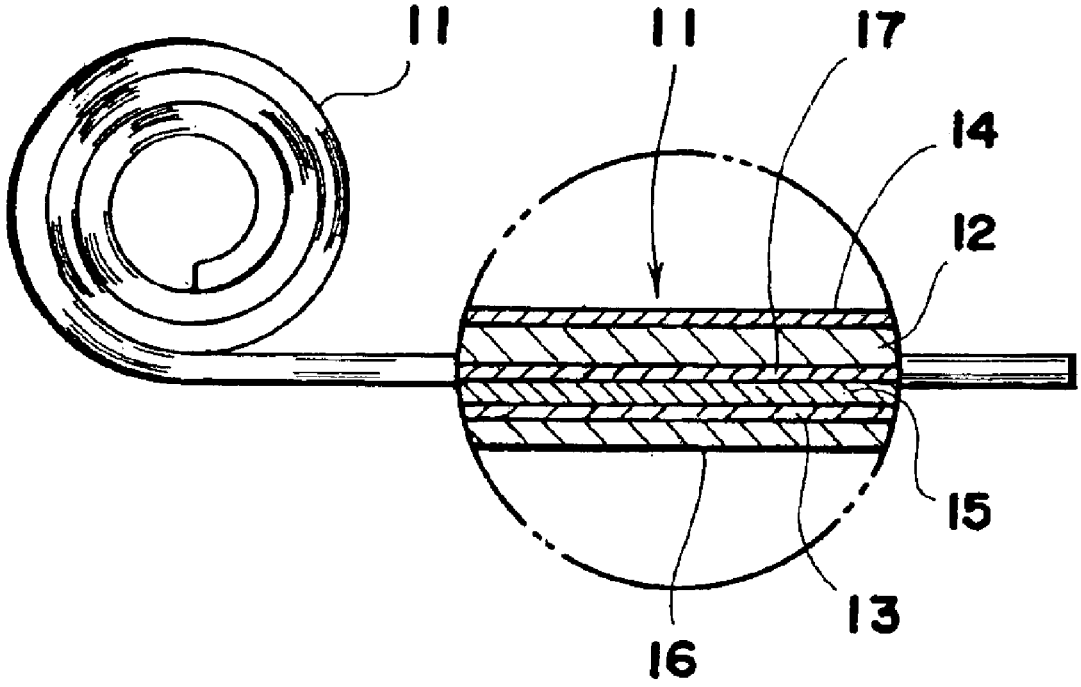
Fig.3 (Prior Art)
FIG. 3 is a frontal explanatory diagram showing a partially enlarged view of a prior art example.

A detailed description will be given below on an embodiment of the present invention which is illustrated in the accompanying drawings. FIG. 1 is a frontal view of a flexographic printing plate mounting sheet according to an embodiment of the present invention and shows a partially enlarged view of the sheet.

This flexographic printing plate mounting sheet is denoted by 1 and is composed of a foamed substrate 2, which has on one side an adhesive layer 4 and a polyethylene terephthalate film 5 on the other side. The remaining side of the polyethylene terephthalate film 5 has an adhesive layer 3, which is protected by release paper 6. The adhesive layer 4 too may be protected by release paper. If the release paper 6 is double-sided in this case, the adhesive layer 3 and the adhesive layer 4 can both be protected by the release paper 6 alone when the flexographic printing plate mounting sheet 1 is wound into a roll as shown in FIG. 1. This eliminates the need to separately prepare release paper for the adhesive layer 4 and is beneficial in terms of manufacture process as well as cost.

The foamed substrate 2 and the polyethylene terephthalate film 5 are unitarily formed to have a uniform thickness. Any known method can be used to form the foamed substrate 2 and the polyethylene terephthalate film 5 unitarily. To give an example, formulated concentrate of a foamed body, e.g., a urethane concentrate solution, is applied to one side of a polyethylene terephthalate film that is moved along the line by a raw material coater to a uniform thickness, and then a heater of the line heats the film and the coat so that the coat is foamed and the two are integrated. Preferably, the foamed body side or both sides of the integrated substrate and film are covered with coated paper that is called "process paper" to even out the thickness and obtain a high level of thickness accuracy.

The foamed substrate 2 is preferably made of urethane foam having a density of 0.3 to 0.6 g/cm$^3$. Although other foam could be used as the foamed substrate, urethane is preferred in light of the cushioning properties and durability necessary for flexographic printing. The density of the urethane foam is set to 0.3 to 0.6 g/cm$^3$. Outside of this density range, urethane foam is too hard or too soft to provide the cushioning properties appropriate for flexographic printing. In this way, the flexographic printing plate mounting sheet is improved in distortion characteristics and can maintain appropriate cushioning properties for a long period of time to endure much repeated use.

The thickness of the polyethylene terephthalate film 5 is set to 12 to 50 μm. A polyethylene terephthalate film thinner than 12 μm does not have sufficient reinforcing power over the foamed substrate 2 to protect the foamed substrate 2 against rapture and other type of breakage when, for example, a flexographic printing plate adhered to an impression cylinder is peeled off of the impression cylinder after use, and neither does it have enough strength to prevent the substrate from overstretching. On the other hand, a polyethylene terephthalate film thicker than 50 μm could impair the elasticity and resilience (cushioning properties) of the foamed substrate. The preferable range for the thickness of the polyethylene terephthalate film 5 is therefore 12 μm or more and 50 μm or less.

The closed cell content of the urethane foamed substrate 2 is set to equal to or higher than 30% and equal to or lower than 60%. The closed cell content affects distortion characteristics of the substrate 2. A closed cell content outside of this range provides poor distortion characteristics and inappropriate cushioning properties, thereby reducing the number of times the flexographic printing plate mounting sheet can be reused, if the sheet can be used at all. With the closed cell content of the urethane foamed substrate set to 30% or more and 60% or less, the flexographic printing plate mounting sheet is improved in distortion characteristics and can maintain appropriate cushioning properties for a long period of time to endure much repeated use.

The closed cell content here has been measured by the Remington-Parazai method (ASTM D1940-62T) with the pressure reduced by 0.1 atm.

The urethane foamed substrate 2 employed in the present invention can be obtained in a manner similar to the way a type of urethane foam that is usually used as a cushion material is manufactured.

For instance, polyetherpolyol having a molecular weight of about 3000 is made to react with isocyanate (index 105). At this point, low molecular weight polyol may be added in order to adjust the hardness. A catalyst, surfactant, and blowing agent are added as additives. The catalyst is chosen from organic metal compounds or amines. The surfactant is a silicone surfactant or surface-active agent for polyurethane foam, such as polydimethyl siloxane. The blowing agent can be water or a CFC (chlorofluorocarbon) substitute. In the present invention, these ingredients, polyol, isocyanate, and the additives, are stirred and mixed to be applied to the top face of the polyethylene terephthalate film 5, which is 50 $\mu$m in thickness, until the coat reaches a thickness of 0.45 mm. The density and closed cell content of the foamed substrate 2 are adjusted by changing the amount of the catalyst, surfactant, and blowing agent added.

The flexographic printing plate mounting sheet 1 has a total light transmittance of 55% or higher with the release paper 6 removed. Accordingly, removal of the release paper 6 renders the flexographic printing plate mounting sheet 1 transparent or translucent, thereby allowing an operator to see positioning marks on an impression cylinder or the like through the flexographic printing plate mounting sheet 1 when mounting a flexographic printing plate to the impression cylinder. Precise positioning and installation in the correct position can therefore be readily achieved without the fear of misalignment. The printing accuracy is thus improved.

The total light transmittance here has been measured by the testing methods for optical properties of plastics according to JIS K7105.

A flexographic printing plate is fixed to the adhesive layer 3 on one side of the flexographic printing plate mounting sheet 1 and the adhesive layer 4 on the other side is fixed to an impression cylinder, to thereby mount the flexographic printing plate to the impression cylinder. Although it is possible to fix the flexographic printing plate to the adhesive layer 4 and fix the adhesive layer 3 to the impression cylinder, adhering the flexographic printing plate to the adhesive layer 3 on the side of the polyethylene terephthalate film 5 is preferred in order to protect the foamed substrate 2 from breakage upon peeling of the flexographic printing plate after use and avoid leaving pieces of the torn substrate 2 and/or the adhesive on the impression cylinder.

Alternatively, if a flexographic printing plate is fixed to the adhesive layer 4 on the one side of the flexographic printing plate mounting sheet 1 and the adhesive layer 3 on the other side is fixed to an impression cylinder, then the foamed substrate 2 can be protected from breakage upon peeling of the flexographic printing plate after use and there is no fear of leaving pieces of the torn substrate 2 and/or the adhesive on the impression cylinder.

In mounting a flexographic printing plate to an impression cylinder through the flexographic printing plate mounting sheet 1, the flexographic printing plate mounting sheet 1 works as follows:

(1) Since the foamed substrate 2 and the polyethylene terephthalate film 5 are unitarily formed, the thickness accuracy is improved and higher printing accuracy is obtained. In addition, with the polyethylene terephthalate film 5 interposed between the foamed substrate 2 and the adhesive layer 3 to which a flexographic printing plate is adhered, peeling of the flexographic printing plate does not break the foamed substrate 2 to leave pieces of the torn foamed substrate 2 and/or the adhesive on the flexographic printing plate. Furthermore, the polyethylene terephthalate film 5 serves as a reinforcing member to prevent overstretch of the foamed substrate.

(2) Urethane foam having a density of 0.3 to 0.6 g/cm$^3$ is chosen for the foamed substrate 2 in order to improve the distortion characteristics of the flexographic printing plate mounting sheet, which enables the flexographic printing plate mounting sheet to maintain appropriate cushioning properties for a long period of time and to stand up to much repeated use.

(3) The closed cell content of the urethane foam as the substrate 2 is set to 30% or more and 60% or less in order to improve the distortion characteristics of the flexographic printing plate mounting sheet to improve distortion, which enables the flexographic printing plate mounting sheet to maintain appropriate cushioning properties for a long period of time and to stand up to much repeated use.

(4) The flexographic printing plate mounting sheet 1 has a total light transmittance of 55% or higher with the release paper 6 removed. Accordingly, the flexographic printing plate mounting sheet 1 is made transparent or translucent, thereby allowing positioning marks on an impression cylinder or the like to be seen through the flexographic printing plate mounting sheet 1 when mounting a flexographic printing plate to the impression cylinder. Precise positioning and installation in the correct position can therefore be readily achieved without causing misalignment.

The substrate of the present invention (Invention Substrate) has been compared with an existing substrate obtained by slicing polyethylene foam (Conventional Substrate) in terms of characteristics, and the comparison result in Table 1 shows that the substrate of the present invention has excellent characteristics.

The standard deviation in Table 1 is obtained by preparing A4 size (210 mm×297 mm) substrate samples and measuring each of them at 116 points at intervals of 2 cm to compare their thickness accuracy.

TABLE 1

| Items | Conventional Substrate (PE foam) | Present invention Substrate |
|---|---|---|
| Density | 0.3 g/cm$^3$ | 0.3 to 0.6 g/cm$^3$ |
| Distortion | Recovery failed | 6 to 9% |
| Thickness (Substrate) | 0.45 to 0.51 mm | 0.45 to 0.48 mm |
| sn-1 (Standard deviation) | 0.0116 | 0.0064 |

EXAMPLE 1

The following blending ratio was employed to stir and mix materials, and the mixture was applied to a polyethylene terephthalate film having a thickness of 50 $\mu$m until the coat reached a given thickness. The coat was then foamed to obtain a urethane foamed substrate integrated with the polyethylene terephthalate film. The urethane foamed substrate had a urethane density of 0.45 g/cm$^3$ and a closed cell content of 46%.

| | |
|---|---|
| Polyetherpolyol with a molecular weight of 3000 | 100 parts by weight |
| 1,4-butanediol | 10 parts by weight |

-continued

| | |
|---|---|
| NCO prepolymer (NCO % = 13) | Index 105 |
| 1,8-diazabicyclo(5,4,0)undecene-7-octoate (Catalyst) | 0.3 parts by weight |
| SH-194 (Dow Corning Toray Silicone Co., Ltd.) (Surfactant) | 0.2 parts by weight |
| Water (Blowing Agent) | 0.4 parts by weight |

EXAMPLES 2 THROUGH 4

For Examples 2 through 4, urethane foamed substrates were obtained in the same way as Example 1 except that the respective amounts of the catalyst, surfactant, and blowing agent added were changed to adjust their density and closed cell content (see Table 2). Each urethane foamed substrate was unitarily formed with a polyethylene terephthalate film having a thickness of 50 $\mu$m.

COMPARATIVE EXAMPLES

A substrate which had a urethane density of 0.45 g/cm$^3$ and a closed cell content of 16% and which was unitarily formed with a polyethylene terephthalate film having a thickness of 50 $\mu$m was prepared as Comparative Example 1. A substrate which had a urethane density of 0.45 g/cm$^3$ and a closed cell content of 66% and which was unitarily formed with a polyethylene terephthalate film having a thickness of 50 $\mu$m was prepared as Comparative Example 2. A polyethylene substrate which had a density of 0.30 g/cm$^3$ and which was laid on top of a polyethylene terephthalate film having a thickness of 50 $\mu$m was prepared as Comparative Example 3.

Examples 1 through 4 and Comparative Examples 1 and 2 were examined for their elastic compressibility and distortion remaining after 25% compression. The results are shown in Table 2.

TABLE 2

| Items | Unit | Example 1 | Example 2 | Example 3 | Example 4 | Comparative Example 1 | Comparative Example 2 |
|---|---|---|---|---|---|---|---|
| Type of substrate | | Urethane | Urethane | Urethane | Urethane | Urethane | Urethane |
| Thickness of substrate | mm | 0.45 | 0.45 | 0.45 | 0.45 | 0.45 | 0.45 |
| Density of substrate | g/cm$^3$ | 0.45 | 0.45 | 0.32 | 0.58 | 0.45 | 0.45 |
| Closed cell content | % | 46 | 31 | 37 | 59 | 16 | 66 |
| Elastic compressibility | % | 7.9 | 7.1 | 7.0 | 8.4 | 5.4 | 7.8 |
| Distortion remaining after 25% Compression | % | 6 | 8 | 9 | 6 | 5 | 18 |

(The substrate thickness includes the thickness of the polyethylene terephthalate film.)

According to Table 2, the elastic compressibility at which a sample is expected to show resilience is very low when the sample has a closed cell content of less than 30% as in Comparative Example 1 whereas a sample having a closed cell content of 30% or higher immediately restores its initial thickness even after compression exceeding 7% as in Example 2. However, when the closed cell content exceeds 60% as in Comparative Example 1, the elastic compressibility is good but distortion remaining after compression is large and appropriate cushioning properties cannot be maintained long.

Examples 1, 3, and 4 and Comparative Example 3 were examined for their total light transmittance and see-through quality.

TABLE 3

| Items | Unit | Example 1 | Example 2 | Example 4 | Comparative Example 3 |
|---|---|---|---|---|---|
| Density of substrate | g/cm$^3$ | 0.45 | 0.32 | 0.58 | 0.30 |
| Thickness | mm | 0.45 | 0.45 | 0.45 | 0.45 |
| Total Light Transmittance | % | 62 | 59 | 64 | 48 |
| See-through Quality | | Clearly observed | Clearly observed | Clearly observed | Not clearly observed |

(The substrate thickness includes the thickness of the polyethylene terephthalate film.)

According to Table 3, the substrates made of polyurethane foam have excellent see-through quality at a density of 0.3 to 0.6 g/cm$^3$ and facilitate correct positioning in mounting a press plate to a cylinder whereas the polyethylene foam of the Comparative Example 3 as a typical existing substrate does not have enough see-through quality and makes positioning difficult in mounting a press plate to a cylinder.

The density, closed cell content, elastic compressibility, distortion remaining after 25% compression, total light transmittance, and see-through quality here are as follows:

(1) Density

The density was calculated by the following equation from the weight and volume measurements of a 100 mm×100 mm piece that was taken from a polyurethane foamed substrate integrated with a polyethylene terephthalate film after the polyethylene terephthalate film was removed.

$$\text{Density (g/cm}^3\text{)=weight (g)/volume (cm}^3\text{)}$$

(2) Closed Cell Content

The closed cell content was measured by the Remington-Parazai method (ASTM D1940-62T) with the pressure reduced by 0.1 atm.

(3) Elastic Compressibility

A substrate together with a polyethylene terephthalate film was cut into 25 mm×25 mm pieces, which were layered to a thickness of about 10 mm. A tester employed had an automatic recording device and was capable of keeping the compression rate constant. A table on which a test piece was to be placed and a pressure plate were those standardized by 6.2 of JIS K-6400. A test piece (substrate) is placed at the center of the table of the tester to be compressed to 15% of its initial thickness at a compression rate of 50 mm/min., and the stress-distortion curve thereof was recorded. In an early-stage area where the stress-distortion curve is linear, the test piece recovered its initial thickness immediately despite repeated compression and relief, and the maximum compressibility of the area where the curve is linear was taken as the elastic compressibility.

The polyurethane thickness here equals (sample thickness —polyethylene terephthalate film thickness)×number of layers, and the compression distance (compression ratio: 15%) here equals polyurethane thickness×0.15.

(4) Distortion Remaining After 25% Compression

A substrate together with a polyethylene terephthalate film was cut into 25 mm×25 mm pieces, which were layered to a thickness of about 10 mm. The layered substrate was held between two metal plates to be compressed by 25% of the thickness of the substrate and kept still at 70° C. for 22 hours. After 30 minutes following retrieval of the sample from between the metal plates, the thickness of the sample was measured to obtain the distortion remaining after compression by the equation below.

Distortion remaining after compression (%)=(pre-test thickness−post-test thickness)/pre-test thickness×100

(5) Total Light Transmittance

The total light transmittance was measured by testing methods for optical properties of plastics according to JIS K7105.

(6) See-through Quality

A line with a width of 0.1 mm was drawn in black on white paper, and a substrate was placed on the paper to examine whether or not the black line was seen clearly through the substrate.

The embodiment described above is not to limit the present invention and various modifications are possible without departing from the spirit of the present invention.

As has been described in detail, a flexographic printing plate mounting sheet of the present invention has the following effects:

(1) The thickness accuracy is improved and higher printing accuracy is obtained.

(2) Peeling of the flexographic printing plate after use does not break the foamed substrate to leave pieces of the torn foamed substrate and/or the adhesive on the flexographic printing plate. Furthermore, the polyethylene terephthalate film serves as a reinforcing member to prevent overstretch of the foamed substrate.

(3) The distortion characteristics are improved, which enables the flexographic printing plate mounting sheet to maintain appropriate cushioning properties (resilience and recovering property) for a long period of time and to stand up to much repeated use.

(4) Positioning marks on an impression cylinder can be seen through the flexographic printing plate mounting sheet when mounting a flexographic printing plate to the impression cylinder. Precise positioning and installation in the correct position can therefore be readily achieved without causing misalignment.

(5) The printing accuracy is improved making it possible to produce a printed copy of better quality.

What is claimed is:

1. A flexographic printing plate mounting sheet comprising a foamed substrate, the foamed substrate having an adhesive layer on one side and a polyethylene terephthalate film on the other side, the polyethylene terephthalate film having on its remaining side an adhesive layer that is protected by release paper, wherein:

the foamed substrate and the polyethylene terephthalate film are unitarily formed;

the foamed substrate is made of urethane foam having a density of 0.3 to 0.6 g/cm$^3$; and the polyethylene terephthalate film has a thickness of 12 to 50 $\mu$m.

2. A flexographic printing plate mounting sheet according to claim 1, wherein a closed cell content of the urethane foamed substrate is equal to or higher than 30% and equal to or lower than 60%.

3. A flexographic printing plate mounting sheet according to claim 1, wherein a total light transmittance is 55% or higher with the release paper removed.

4. A flexographic printing plate mounting sheet according to claim 2, wherein a total light transmittance is 55% or higher with the release paper removed.

* * * * *